US007997995B2

(12) United States Patent
Willis

(10) Patent No.: US 7,997,995 B2
(45) Date of Patent: Aug. 16, 2011

(54) STR8 PUTT

(76) Inventor: Daniel Willis, Bradenton, FL (US)

( * ) Notice: Subject to any disclaimer, the term of this patent is extended or adjusted under 35 U.S.C. 154(b) by 0 days.

(21) Appl. No.: 12/699,877

(22) Filed: Feb. 4, 2010

(65) Prior Publication Data

US 2011/0092303 A1 Apr. 21, 2011

Related U.S. Application Data

(60) Provisional application No. 61/279,071, filed on Oct. 16, 2009.

(51) Int. Cl.
*A63B 69/36* (2006.01)

(52) U.S. Cl. ..... 473/265; 473/257

(58) Field of Classification Search ..... 473/218, 473/219, 238, 239, 257, 261, 264, 265, 266, 473/268, 269

See application file for complete search history.

(56) References Cited

U.S. PATENT DOCUMENTS

| | | | | |
|---|---|---|---|---|
| 3,269,733 | A * | 8/1966 | Taddie et al. | 473/258 |
| 5,273,284 | A * | 12/1993 | Montgomery | 473/258 |
| 5,338,037 | A * | 8/1994 | Toyohara | 473/268 |
| 5,375,833 | A * | 12/1994 | Marier, Jr. | 473/261 |
| 6,129,639 | A * | 10/2000 | Brock et al. | 473/260 |
| 6,695,710 | B2 * | 2/2004 | Yamada | 473/265 |
| 2005/0277482 | A1 * | 12/2005 | Bennett | 473/257 |

* cited by examiner

*Primary Examiner* — Nini Legesse

(74) *Attorney, Agent, or Firm* — Oakwood Law Group, LLP

(57) ABSTRACT

A putter guide for guiding a putter shaft during a putting stroke has a pair of guide rails for guiding the shaft of a putter, a base member; and a post coupling the base member to the pair of guide rails for elevating the pair of guide rails above the ground to be closer to a grip on the putter. The guide rails are adapted to fold down beside the main post and both are adapted to fold down between two parallel tubes of the base to allow a golfer to carry the putter guide.

9 Claims, 4 Drawing Sheets

STR8 PUTT

REFERENCE TO RELATED APPLICATIONS

This patent application claims the benefit of U.S. Provisional Application No. 61/279,071 filed on Oct. 16, 2009, the disclosure of which is incorporated herein by reference in its entirety.

BACKGROUND OF THE INVENTION

1. Field of the Invention

The present invention relates generally to golf and more specifically to a guiding apparatus for guiding a putter shaft through a straight back and through a putting stroke.

2. Description of Related Art

When a golf ball reaches the green, the player then putts the ball into the hole. The goal is to get the ball into the hole with as few strokes as possible when using a putter. When putting, it is important that the shaft and blade of the putter be moved in a straight back and through direction to have a putting swing that will move the ball in a straight line toward the target. In addition, when putting, the golfer's head should be held still and the club swing should be from the player's upper body including his/her arms and shoulders and not from the hip. During putting a player should be looking directly at the ball or slightly ahead of the ball.

When practicing putting, it is difficult for the player to determine whether the shaft of the putter is truly following a desired path of moving straight back and then reversing motion by moving along the same path straight forward toward the ball. If the golfer's head moves to watch the putter shaft while he/she is making the swing, the practice swing will not be a true practice swing. Thus, if the golfer is watching the putter shaft as it is going back instead of the ball, it may not be going straight back and then straight forward when the golfer is actually playing on a golf course and looking at the golf ball while actually putting a ball.

The use of various types of devices for improving a golfer's putting stroke is known in the prior art. More specifically, by way of example, U.S. Pat. No. 5,882,267 to Roe discloses a golf putting trainer having a first elongated member; a second elongated member which is positioned generally parallel to the first elongated member, and is spaced apart from the first elongated member; a connecting member which is positioned between the first elongated member and the second elongated member and which is connected to the first elongated member near a first end of the first elongated member, and is connected to the second elongated member near a first end of the second elongated member; a target which is slidably mounted to the connecting member and is in a slidable relationship with the connecting member, wherein the target is positioned between the first elongated member and the second elongated member.

U.S. Pat. No. 5,320,355 to Johnson discloses a guide for guiding a putter blade during a putting stroke. A first elongated member has a first end and a second end where the second end has an aperture which extends into the second end. A second elongated member also has a first and second end and the second end of the second elongated member also has an aperture which extends into the second end. A unitary accordion member which has a first end and a second end each of which has a protruding knuckle sized to be frictionally fit into the apertures of the second ends of the first and second elongated members. The accordion member is collapsible and extendable to vary the distance between the second ends of the first and second elongated members.

U.S. Pat. No. 5,320,355 to Kim discloses apparatus for refining a golfer's putting skill by making the starting and ending points of the putting stroke easy to evaluate. The apparatus is a rectangular frame which is placed on the ground with the head of the putter inside the frame and perpendicular to the long sides of the frame. A golf ball is placed on the ground roughly in the center of the frame. The putter is drawn back a given distance to the edge of an adjustable backstop. At the end of the stroke the putter just contacts a flexible rod whose position along the frame can be adjusted. The frame has both fixed and adjustable markings to allow the golfer to judge the beginning of the putting stroke and then follow through.

U.S. Pat. No. 5,026,066 to Kane discloses a guide that has a forwardly facing flat surface and a pair of rearwardly extending mutually spaced leg engaging members contoured to be held between a golfer's legs. The leg engaging members are mounted between a pair of parallel tracks on the rear of the forwardly facing flat surface, and the spacing between the leg engaging members may be varied by moving same along the length of the parallel tracks. An adjustable length guide clamp has one end for attachment to the shaft of a putter and the other end for sliding movement along the forwardly facing flat surface of the guide member.

U.S. Pat. No. 5,362,057 to Arima discloses a golf putting practice device having a bottom panel, a left side panel and a right side panel where the left and right side panels are connected to the bottom panel, and a notch that exposes a putting surface which is adapted to receive a golf ball. The left and right side panels are perpendicularly oriented to the bottom panel and spaced apart a distance at least slightly greater than the length of the head of the golf putter. Each of the side panels has a top and a bottom edge, and a plurality of grooves in the top edge. At least one relocatable rod having a length greater than the distance between the left and right side panels is removeably positioned in corresponding grooves in the left and right side panels. The bottom panel is substantially transparent and has a reflective surface in which a golfer can see his/her reflection before, during, and after putting. Longitudinal and lateral lines on the bottom panel of the device provide the golfer with visual guides for a straight putting stroke with the head of the putter square to the straight line of the putting stroke.

U.S. Pat. No. 3,604,711 to Hansburg discloses an upright post which may be detachably secured in the putting green at the position of the ball, the post rigidly mounting a reel at its lower end which carries a cord or tape which may be extended and detachably secured at the edge of the hole, the tape serving as a guide for the golfer. The height of the upright post is such that it may be grasped by the golfer without bending.

U.S. PreGrant Pub. No. 2003/0148816 to Tryon discloses a golf-putting arm guide which has an arm serpentine that is attached detachably to a top end of a golf-club grip and articulated to entwine the golfer's upward arm in straightness orientation for acquiring a sense of the straightness orientation to learn putting accuracy. The arm serpentine is preferably a wire having a club-grip end that fits snugly into a club-grip orifice in the top end of the golf-club grip. The arm serpentine includes a fore-arm guide proximate a mid section that fits snugly against an inside of the front or upward forearm of the golfer. Outwardly from the forearm guide, the arm serpentine includes an arm hook that hooks onto golfer's upward or front arm. The club-grip end can include one or more linear ridges as anti-rotation fins and a snap ridge which can be built onto or attachable to the club-grip end of the arm serpentine. The arm serpentine is bendable to fit one arm size or a class of arm sizes rigidly. The arm serpentine can be predeterminedly flexible and have fixable rigidity with ball-and-socket beads tightened intermediate to the arm hook and the club-grip end. Also, the arm serpentine can have structural memory with metallic or non-metallic material.

U.S. PreGrant Pub. No. 2005/0130756 to Chang discloses two rails each having a curved upper surface corresponding to a curved moving pathway of a golf club head while swinging the golf club head relative to the rails, and a link coupling the rails together, to maintain a gap formed between the rails. The curved upper surfaces of the rails are used to guide users to practice putting exercises. Each of the rails includes a graduation disposed on the curved upper surface. Each of the rails includes an outer bulge higher than an inner bar, to form a shoulder between the inner bar and the outer bulge, and having a graduation disposed on a curved upper surface.

SUMMARY OF THE INVENTION

In an exemplary embodiment of the present invention, there is disclosed a putter guide for guiding a putter shaft during a putting stroke. The putter guide has a pair of guide rails for guiding the shaft of a putter, a base member; and a post coupling the base member to the pair of guide rails for elevating the pair of guide rails above the ground to be closer to a grip on the putter. The guide rails are adapted to fold down beside the main post and both are adapted to fold down between two parallel tubes of the base to allow a golfer to carry the putter guide.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals, wherein

DESCRIPTION OF THE PREFERRED EMBODIMENT

The free standing golf putting practice device disclosed allows a golfer to practice the widely accepted straight back and through putting stroke. The device, when unfolded from its collapsed carrying position, is free standing and can be used by a golfer to practice his/her putting strokes either indoors or on a practice putting green. The practice device has two guide rails which are parallel to each other and to the ground. The two guide rails form a horizontal channel which is used as a guide for the shaft of a putter. The space between the guide rails is adjustable and the guide rails can be raised and lowered to be near the grip which is effective in training the hands and arms of the user to move in a straight back and through motion. Most prior art putting training devices guide the head of the putter or try to force a user to putt in a certain way such as, for example, to assume a certain body stance, alignment and to look only at the ball or slightly ahead of the ball. The putting practice device here disclosed allows a golfer to have a free flowing swing with light guidance of the shaft position.

Other prior art putter training devices attach to the head of the putter to force the putter head to have a certain motion or they rest on the shaft. With the putter guide here disclosed the golfer has a more natural feel of his/her swing with guidance on what is actually a true straight back and through swing.

The golf putting practice device here disclosed can help a user become a better putter by: 1) Training the user to swing the putter straight back and through; 2) Training the user to keep his/her head down; 3) Allowing the transition from back swing to forward to become smoother; 4) Teaching the user to keep his/her upper body still instead of swaying; and 5) Training the user to keep his/her shoulders properly aligned with the target.

Figure 1:
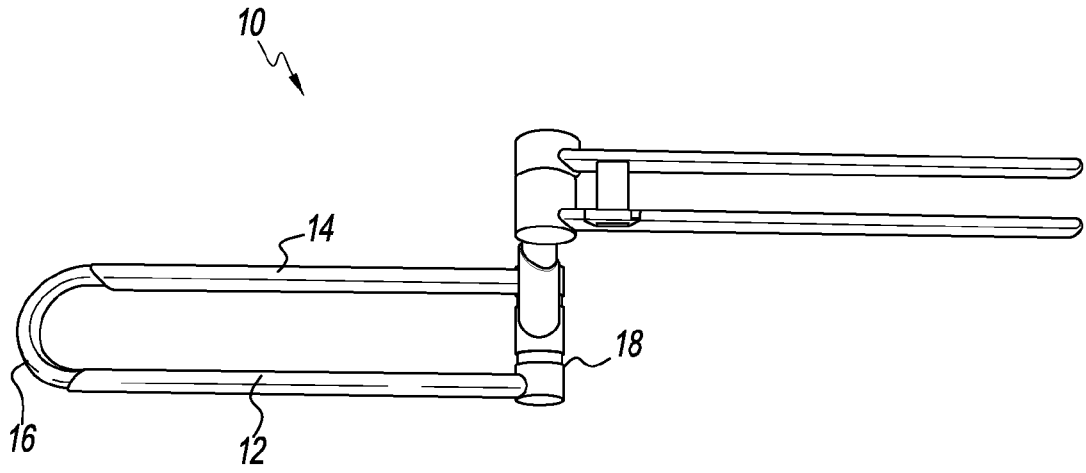
FIGS. 1 and 2 are perspective views of a free standing golf putting practice device with guide rails for guiding the shaft of a golf club putter in accordance with the principles of the invention.
Figure 2:
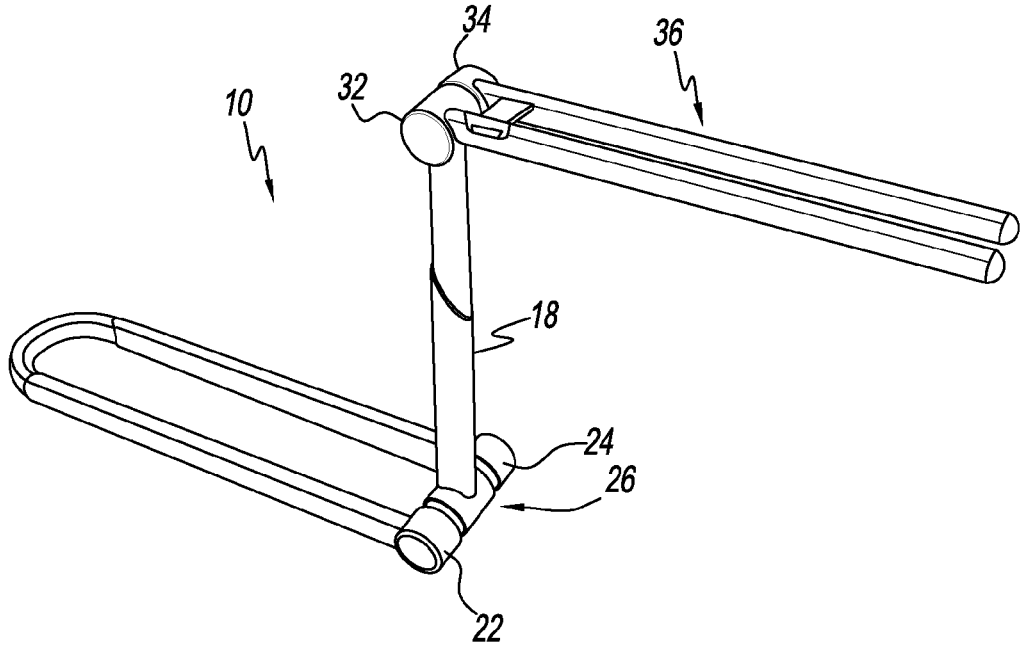

Referring to FIGS. 1 and 2, there is shown a perspective view of the free standing golf putting practice device with guide rails for the shaft of a golf club putter where the guide rails are located at a low setting, FIG. 1, and a high setting, FIG. 2, in accordance with the principles of the invention. The golf club putter training device 10 has a base which consists of two tubes 12, 14 joined together at one of their ends with a U shaped tube 16, which is composed of a heavy material such as lead, iron, a hollow tube filled with sand or lead, and the like. The other ends of the tubes 12, 14 are connected to a main post 18 via a rotatable coupling 20 having two stationary two end members 22, 24 and a rotatable center member 26. The main post 18 is centrally located between the two tubes 12, 14 and the rotatable center member 26 is frictionally coupled to the end members 22, 24 such that the main post 18 can be set to any upright position and will remain in that upright position relative to the base without falling over.

Main post 18 is a telescoping tube consisting of a lower tube and an upper tube that slides into the lower tube. The two tubes of the main post are sized to allow the top of the main post to be raised to a height of between 18 inches and 32 inches above the ground. Holding means such as a screw that threads into the lower tube and contacts the upper tube (not shown) can be provided to lock the lower tube to the upper tube when setting the main post to a desired height.

Figure 3:
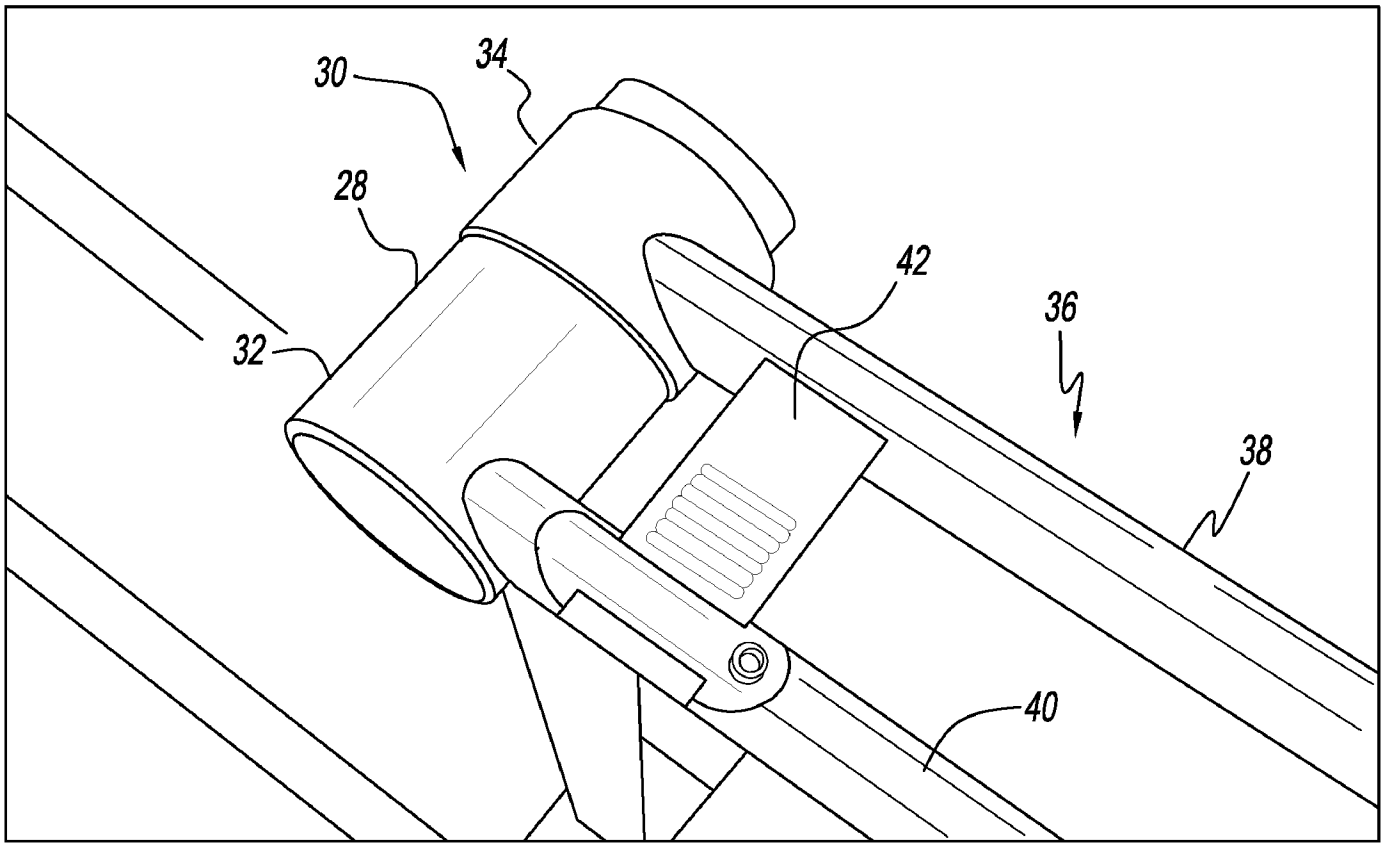
FIG. 3 is a top perspective view of the free standing golf putting practice device showing the scale that indicates the separation between the adjustable guide rails in accordance with the principles of the invention.

Referring to FIG. 3, which is a top perspective view of the free standing golf putting practice device, the top of the upper tube of the main post is attached to a center cylinder 28 of a second rotatable coupling 30 which is rotatably and slidably coupled to sleeves 32, 34 at each end. Each sleeve is frictionally coupled to the center cylinder such that they can be rotated and/or moved closer or further apart on the center cylinder and hold that position until repositioned. If desired, set screws (not shown) can be provided to lock the sleeves to the center cylinder. Attached to sleeves 32, 34 are guide rails 38, 40 which can be moved closer together or further apart and locked in position. A flat metal plate 42 which is attached to rail 38 and is slidably coupled to rail 40 has on its top surface a scale which is used to indicate the spacing between the rails. The flat metal plate 42 also functions as an aligning member to keep the guide rails in alignment with each other.

Figure 4:
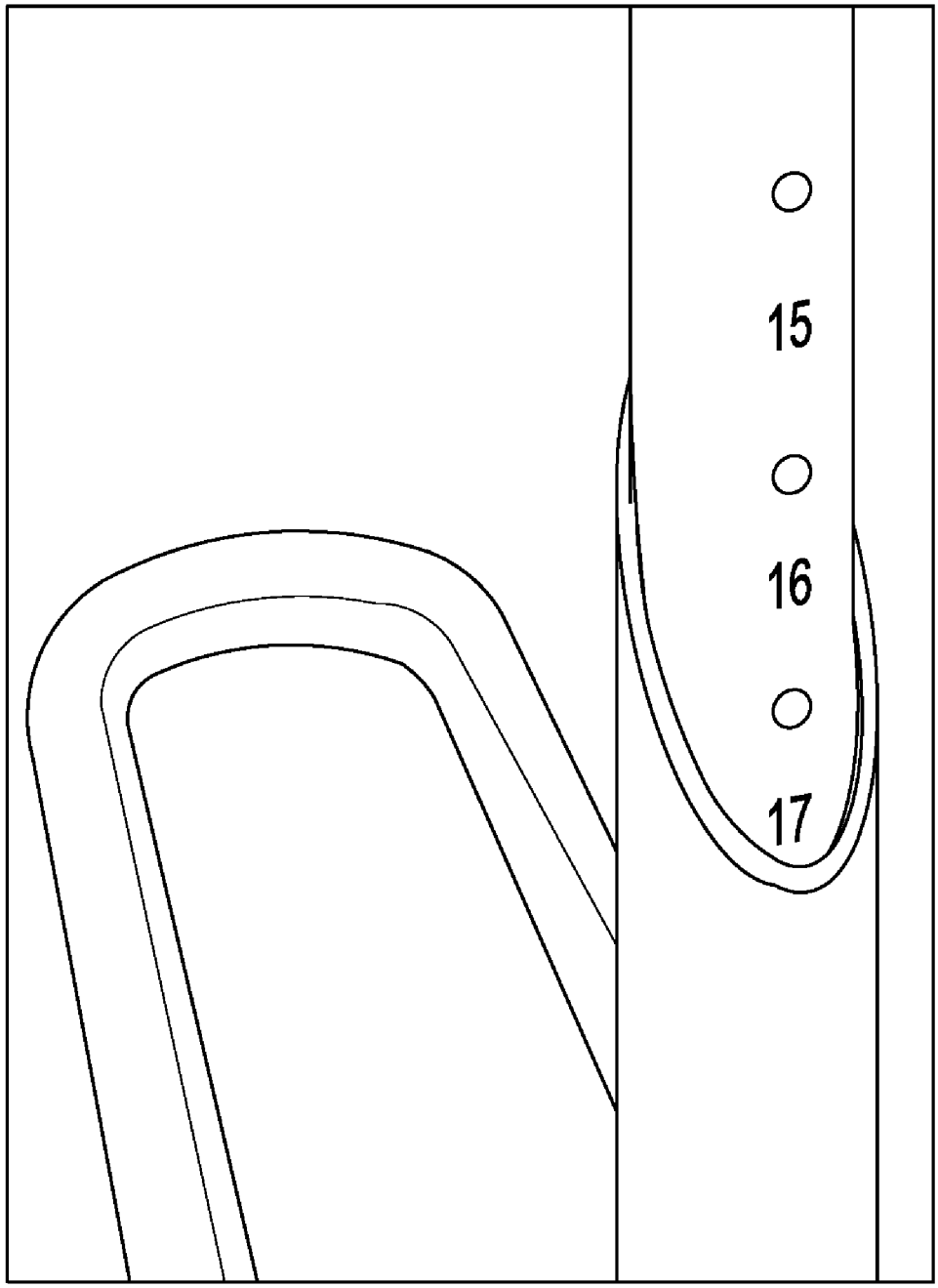
FIG. 4 is a view of the free standing golf putting practice device showing the scale that indicates the height of the adjustable guide rails in accordance with the principles of the invention.
Figure 5:
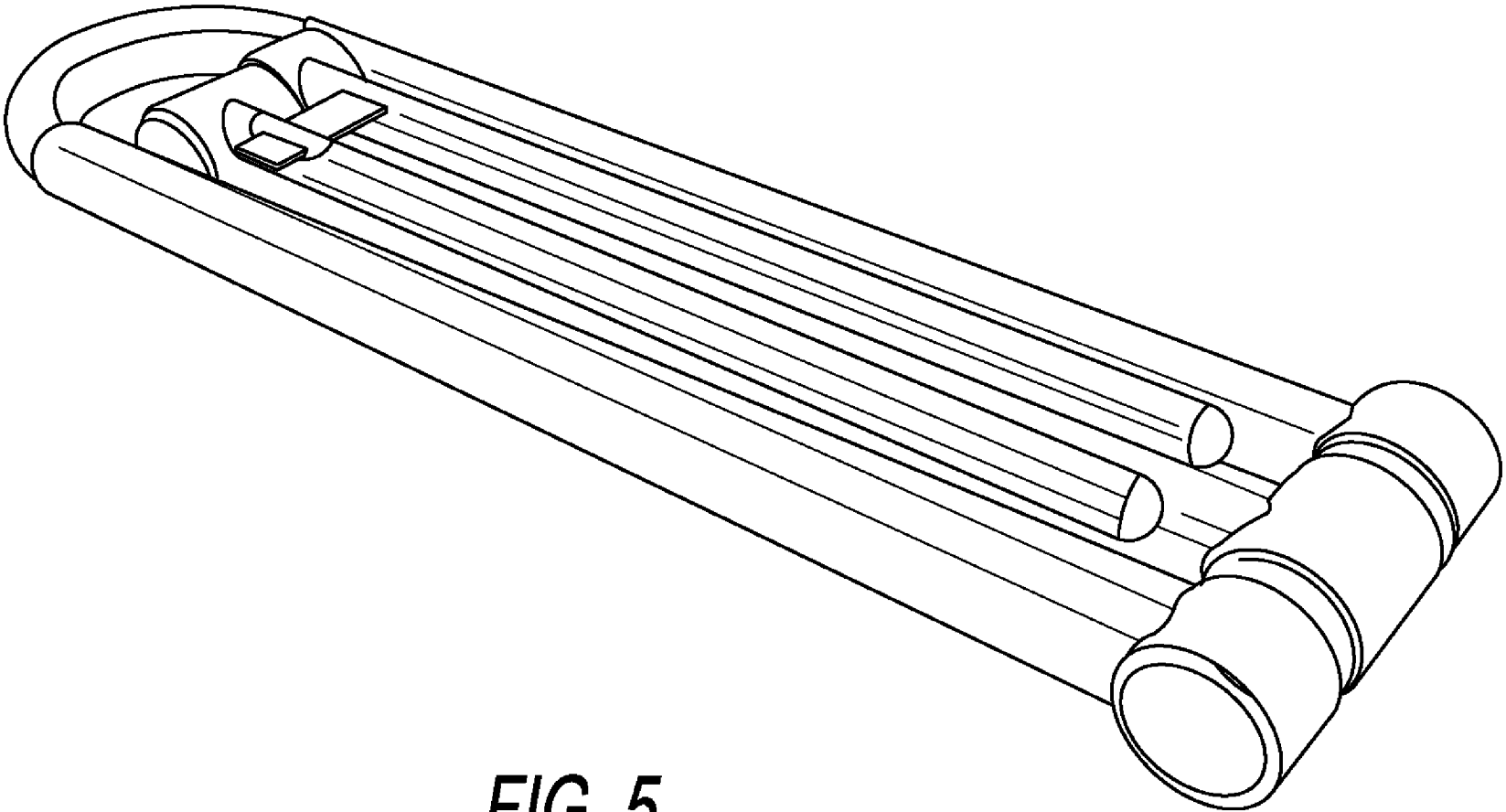
FIG. 5 is a perspective view of the free standing golf putting practice device in a folded down position in accordance with the principles of the invention.

Referring to FIG. 4 which is a view of the free standing golf putting practice device showing the scale that indicates the height that the adjustable guide rails are located above the ground and FIG. 5 which is a perspective view of the free standing golf putting practice device in a folded down position. The device folds down onto itself and the telescoping main post allows the golf practice device to be used by anyone with any type of putter. When being folded down, the guides swing down flush with the main post and the main post then swings down flush with the base. This folding feature where the various parts are located in a common plane and flush with the base provides a lightweight, portable practice device that can fit inside the standard golf bag.

The guide rails are between 16 and 20 inches long where 18 inches is preferred and are adjustable to be spaced apart from one half of an inch to about four inches more or less, where one half of an inch is the minimum width for a putter to move between. Repeating, when the device is being stored, the guide rails fold down beside the main post and both then fold down between the two tubes of the base which allows a golfer to carry and use the practice device with ease.

In use, the guide rails are parallel to the ground and the golfer stands parallel, either to the left of the right, to the guide rails. The shaft of the putter swings between the guide rails which guides the club to a straight back and through motion. The spacing between the guide rails is adjustable which allows the golfer to widen or narrow the space between the guide rails depending on how comfortable the golfer feels with his/her stroke.

The goal is to have the space between the guide rails as narrow as possible so that the golfer knows the club is going as straight as possible, The base of the device has sufficient weight and width to stand on its own without tipping over in any direction. The surface of each guide rail can be serrated or they can include electrical contact means which will indicate when the shaft of the putter contacts a guide rail. For example, when the rails are serrated a low frequency noise will be generated when the metal shaft of the putter rubs against the rail. When electrical contacts are a part of the guide rails, a light or a buzzer can be located on the device to indicate that the putter shaft is hitting or rubbing against a guide rail. A person with ordinary skill in the art can adapt the guide rails to include contact means which will complete an electrical circuit when the metal shaft of a putter contacts a guide rail and, therefore, such a circuit is not here shown.

The light or noise indicator will light up or make a noise when the golfer strikes the side of the guide rails with the shaft of a putter allowing for instant feedback of a non-straight swing. A line located on the top of each guide rail is provided to indicate where to start the putter swing and also provides a more visual guide for making a correct stroke.

The telescoping main post allows the putting practice device to be used with almost any putter made. By adjusting the height of the guide rails, the device can be used with long putters and with children using a short putter, and provide the best way to learn the straight back and through motion when putting because there is no "forced" feel to the stroke.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A putter guide for guiding a putter shaft during a putting stroke comprising:

a pair of guide rails for guiding the shaft of a putter;

a base member; and a post rotatably coupled to the base member and to the pair of guide rails for elevating the pair of guide rails above the ground to be closer to a grip on said putter;

wherein said post is a telescoping tube having a lower member which is attached to said base member with a first rotatable coupling and an upper member which is attached to said pair of guide rails with a second rotatable coupling;

wherein said pair of guide rails are adapted to be rotated about said second rotatable coupling to be substantially parallel to the ground and are slidably coupled to said second rotatable coupling to be spaced apart between one half of an inch and four inches; and wherein a scale is coupled to said pair of guide rails to indicate a spacing between said rails.

2. The putter guide of claim 1 wherein holding means is coupled to said guide rails to keep said rails at the spacing to which it is set.

3. The putter guide of claim 1 wherein electrical contact means is coupled to said guide rails to activate a light or sound an alarm when a shaft of a putter contacts a guide rail.

4. The putter guide of claim 1 wherein serrations are located on said guide rails to make a sound when a moving shaft of a putter contacts a guide rail.

5. A putter guide for quidinq a putter shaft during a putting stroke comprising:

a pair of guide rails for quidinq the shaft of a putter;

a base member; and a post rotatably coupled to the base member and to the pair of guide rails for elevating the pair of guide rails above the ground to be closer to a grip on said putter;

wherein said post is a telescoping tube having a lower member, and an upper member slidably coupled to said lower member; and wherein said telescoping tube has a scale which indicates the height at which the post is set.

6. The putter guide of claim 5 wherein holding means is coupled to said telescoping tube to keep said tube at a height to which it is set.

7. A putter guide for guiding a putter shaft during a putting stroke comprising:

a pair of guide rails for guiding the shaft of a putter;

a base member; and a post rotatably coupled to the base member and to the pair of guide rails for elevating the pair of guide rails above the ground to be closer to a grip on said putter;

wherein said post is a telescoping tube having a lower member which is attached to said base member with a first rotatable coupling and an upper member which is attached to said pair of guide rails with a second rotatable coupling; and wherein said base member consist of two parallel tubes joined together at one of their ends with a weight and their other ends are attached to said first rotatable coupling; and wherein said telescoping tube is located between said two parallel tubes.

8. The putter guide of claim 7 wherein said weight is iron or lead.

9. The putter guide of claim 7 wherein the guide rails are adapted to fold down beside the main post and both are adapted to fold down between the two parallel tubes of the base which allows a golfer to carry the putter guide.

* * * * *